US007204764B2

(12) United States Patent
Gottfried

(10) Patent No.: US 7,204,764 B2
(45) Date of Patent: Apr. 17, 2007

(54) HOCKEY SAFETY NET

(75) Inventor: Ray Gottfried, Littleton, CO (US)

(73) Assignee: University of Denver, Denver, CO (US)

( * ) Notice: Subject to any disclaimer, the term of this patent is extended or adjusted under 35 U.S.C. 154(b) by 0 days.

(21) Appl. No.: 10/906,643

(22) Filed: Feb. 28, 2005

(65) Prior Publication Data

US 2006/0194637 A1 Aug. 31, 2006

(51) Int. Cl.
*A63C 19/04* (2006.01)
*A63C 19/00* (2006.01)

(52) U.S. Cl. ..... 472/92; 473/490

(58) Field of Classification Search ..... 472/89–92, 472/136; 434/247, 256; 473/454, 478, 490
See application file for complete search history.

(56) References Cited

U.S. PATENT DOCUMENTS

| | | | | |
|---|---|---|---|---|
| 3,849,935 | A * | 11/1974 | Hale | 49/34 |
| 4,083,562 | A | 4/1978 | Zepper | 273/127 B |
| 4,489,941 | A | 12/1984 | Shieh | 273/26 A |
| 5,254,040 | A * | 10/1993 | Eller et al. | 472/94 |
| 5,643,094 | A * | 7/1997 | Macri et al. | 472/92 |
| 5,690,339 | A * | 11/1997 | Chen | 273/400 |
| 5,816,956 | A | 10/1998 | Ellis et al. | 473/4.9 |
| 6,004,218 | A * | 12/1999 | Keating et al. | 472/94 |
| 6,122,925 | A | 9/2000 | Rawlins | 62/235 |
| 6,688,026 | B1 | 2/2004 | Clark | 40/604 |
| 6,793,595 | B1 | 9/2004 | Monnet | 473/478 |

FOREIGN PATENT DOCUMENTS

| | | |
|---|---|---|
| WO | WO-99/06125 A1 | 2/1999 |
| WO | WO-01/34924 A1 | 5/2001 |

OTHER PUBLICATIONS

"Hockey Barrier Netting," Seattle Marine & Fishing Supply Co., web pages located at http://www.seamar.com/nets/hockey.html.
"Arena," Sport Systems Canada, web pages located at http://www.sportsystemscanada.com/a/pn.html.
"Spectator Netting," Seaway Plastics Ltd., 2002-2004, web pages located at http://www.quedltd.com/hockey-spectator-net.asp.
"Protective Netting," Sport Systems Unlimited Corp., 2003, web pages located at http://www.sportsystemscorp.com/phototour/protectivenetting.html.

* cited by examiner

*Primary Examiner*—Kien Nguyen
(74) *Attorney, Agent, or Firm*—Holland & Hart LLP; Kenneth C. Winterton, Esq.

(57) ABSTRACT

A method and system are provided for supporting, installing, and removing a safety net or other partition in a multiple use facility. The support system is comprised of a number of linear or substantially linear segments that are coupled together in a configuration that approximates the shape of the area being partitioned. The support system may be easily assembled and the safety net or other partition secured thereto. The support system is attached at various points to a lifting system that can lift the support system, and safety net or other partition, into position. Similarly, the support system may be lowered, disassembled, and stored for further use.

16 Claims, 6 Drawing Sheets

HOCKEY SAFETY NET

FIELD OF THE INVENTION

The present invention is directed to partitions in multiple-use facilities, and, more particularly, to a system and method for hanging a net in a sporting arena.

BACKGROUND

Present day sporting events are often played with objects, such as baseballs, hockey pucks, and lacrosse balls, to name but a few, that move at relatively high speeds. Spectator safety at such events is often a concern, and safety systems are commonly used to reduce or eliminate the possibility that an object from the sporting area will enter the spectator area. For example, hockey rinks generally have glass extending above dasher boards that provides spectators protection from pucks flying from the rink while also providing good visibility for spectators. Similarly, baseball fields commonly have nets or fencing placed at a certain distance behind and to the sides of the batting boxes to reduce the number of foul balls entering the spectator area.

While such safety systems provide some amount of protection to spectators, there continues to be some risk of injury for spectators attending such events. For example, at a hockey rink, a puck may come out of the arena above the above-mentioned glass and enter into the spectator area. As a result, some arenas place a net around portions of the rink to reduce the incidence of pucks entering the spectator area. Such nets are commonly placed only around the ends of the rink in proximity to the goals, as pucks leaving the arena above the glass in these areas are likely to have a higher velocity, and thus a higher likelihood of spectator injury, than pucks leaving the arena at other areas. Such nets are useful for reducing the incidence of pucks entering the spectator area, and the installation and replacement of such nets can be very time consuming and labor intensive.

Furthermore, such sporting events are often played in facilities that have multiple uses. For example, it is common that hockey teams and basketball teams use a common facility. Additionally, it is common that the playing season for the different sports played at a facility overlay, often resulting in games scheduled on consecutive days that require that the facility be converted between configurations in a relatively short time period.

SUMMARY OF THE INVENTION

The present invention recognizes the need for an economical and relatively simple system for installing and removing a net or other partition in a multiple use facility. The present invention provides a system that is both relatively inexpensive and may be installed and removed within a relatively short time period and using relatively little labor.

In one embodiment, the present invention provides a safety net system for reducing the number of objects entering a spectator area from a sporting area in a sports venue. The system comprises: (a) a plurality of support members; (b) a plurality of couplings, each coupling operably interconnected with two of the support members, the support members coupled in a substantially horizontal plane and at a predetermined angle relative to one another and forming a piecewise linear approximation of a boundary of at least a portion of the sporting area; and (c) a safety net attached to the support members and extending in a substantially vertical direction therefrom to the boundary associated with the sporting area. The safety net reduces the incidence of objects from the sporting area entering the spectator area. In one embodiment, each of the support members are substantially linear.

In another embodiment, the safety net system also includes a lift system operably interconnected with the plurality of support members and operable to lift the support members and safety net into a predetermined position. The lift system may be operated by a single operator using a controller that operates the lift system. The sporting arena may be an ice hockey arena, with the safety net extending between the support members and an upper portion of a glass partition associated with the hockey arena. In one embodiment, the plurality of support members include 12 support members located at each end of the hockey arena. The support members are coupled together at one of an angle of about 11.25 degrees, about 22.5 degrees, and zero degrees. The support members, in one embodiment, are substantially square steel tubes having a support member securement hole at both ends thereof. The couplings are adapted to engage the steel tubes and have coupling securement holes substantially aligned with the support member securement holes when the support member is engaged with the coupling. A securement pin may be placed through the aligned securement holes to secure the support members to the couplings.

In another embodiment, the present invention provides a system for supporting a removable screen or curtain in a multiple use event center. The system comprises: (a) a plurality of support members comprising a partition attachment point and a coupling point; (b) a plurality of couplings comprising coupler portions sized to operably interconnect with the coupling point, the coupler portions operable to connect a first support member in a substantially horizontal plane to a second support member at a fixed angle with respect to the first and second coupling points, wherein when the plurality of support members are assembled into a shape substantially corresponding to a boundary of the screened area; and (c) a removable screen or curtain operably interconnected with the support members and hanging substantially vertically therefrom to the boundary of the screened area. Each of the support members may be substantially linear, and assembled to form a piecewise linear approximation of the boundary of the area being screened. The removable screen may be a safety net and the screened area is a sporting area. In one embodiment, the sporting arena is an ice hockey arena and the safety net extends between the support members and an upper portion of a glass partition associated with the hockey ice rink.

In another embodiment, the present invention provides a method for partitioning a portion of a multiple-use facility comprising: (a) assembling a plurality of segments into a predetermined configuration corresponding to a piecewise linear approximation of a boundary of the area to be partitioned; (b) fixing a partition to the segments; and (c) raising the segments and the partition such that the partition hangs substantially vertically from the segments to the boundary of the area being partitioned. The assembling step comprises, in an embodiment: (a) obtaining a segment; (b) obtaining a coupling having a predetermined angle associated with the boundary of the area to be screened; (c) affixing the coupling to the segment; (d) obtaining a second segment; (e) affixing the second segment to the coupling such that the segment and the second segment are coupled together at the predetermined angle; and (f) repeating the steps of affixing and obtaining until the segments form the predetermined configuration. The plurality of segments may then be affixed to a lift system and lifted to raise the partition. The partition, in an embodiment, is a safety net and the area to be partitioned corresponds to a boundary of a sporting arena.

DETAILED DESCRIPTION

The present invention provides a method and system for supporting, installing, and removing a safety net or other partition in a multiple use facility. The support system is comprised of a number of linear or substantially linear segments that are coupled together in a configuration that approximates the shape of the area being partitioned. The support system may be easily assembled and the safety net or other partition secured thereto. The support system is attached at various points to a lifting system that can lift the support system, and safety net or other partition, into position. Similarly, the support system may be lowered, disassembled, and stored for further use. The lifting system may be operated by a single person using a single controller.

Figure 1:
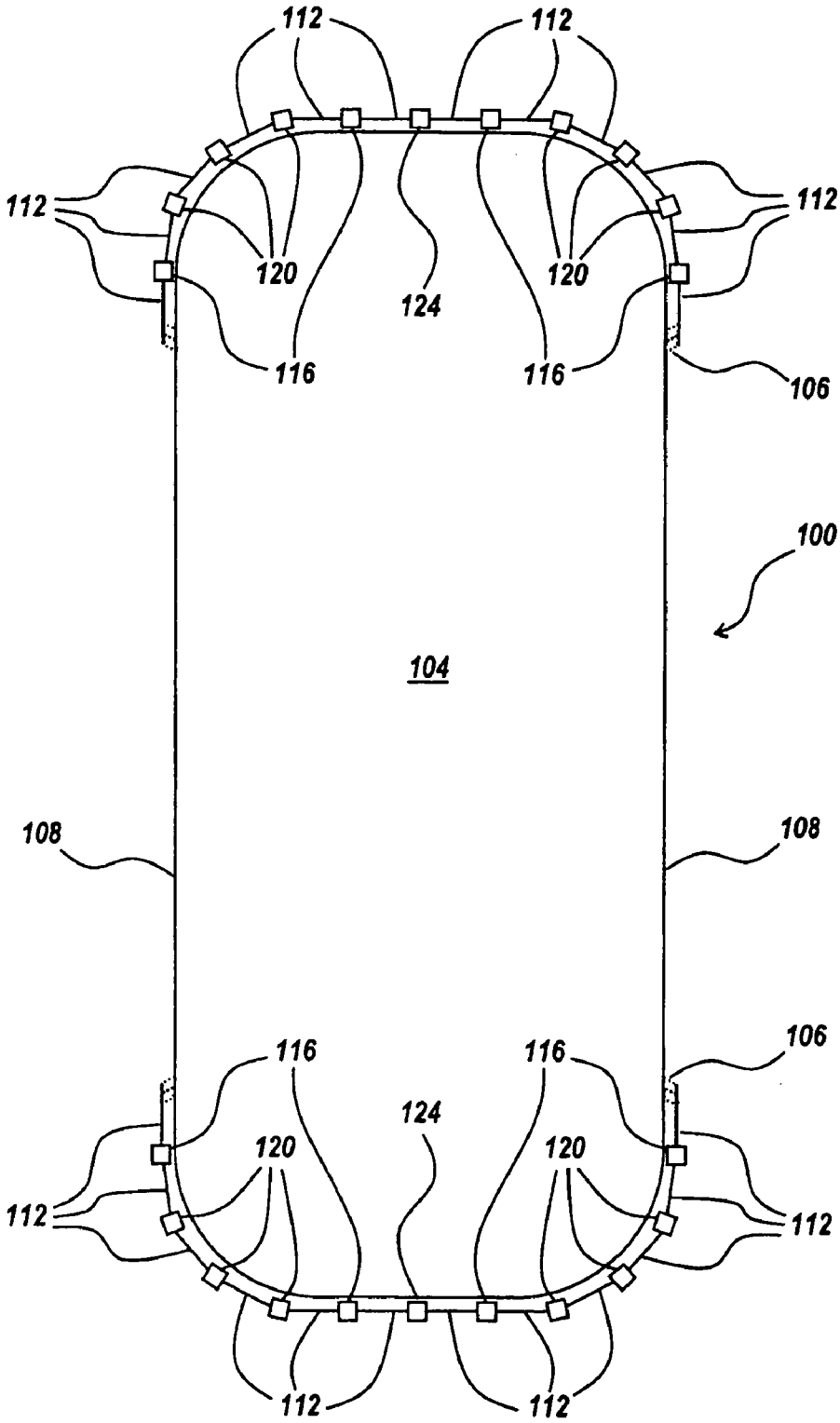
FIG. 1 is an illustration of a sporting arena having a safety net of an embodiment of the invention.

Referring now to FIG. 1, an embodiment of a safety net system 100 the present invention is illustrated with respect to a hockey rink 104. As is well understood, hockey is played on an ice surface 104, using a puck that is moved by players, and may obtain relatively high velocities. Furthermore, as mentioned above, pucks that leave the playing area on the ends of the rink are likely to have higher velocities, and thus a higher likelihood of injuring a spectator, than those that may leave the playing area at other areas. Accordingly, in this embodiment, a safety net 106 is hung at either end of the playing area 104. As is also understood, a hockey arena also includes dasher boards and glass that extends above the dasher boards for a certain distance, with the dasher boards and glass generally referred to as 108 in FIG. 1. The safety net 106 extends between a top portion of the dasher boards and glass 106 up to a number of hanging segments 112. The hanging segments 112, in this embodiment, are linear segments of square tube steel that are 11 feet in length. As will be understood, the segments may be in other lengths and may be made in other shapes and of other material. In this embodiment, square steel segments are selected to provide adequate structural strength to support the safety net 106 while also being relatively inexpensive and readily obtainable. Other materials may be selected in embodiments where the weight of the segments is an important consideration and/or where the structural strength of the segments is an important consideration. The material, length, and shape are all attributes of the segments 112 that may be selected based on the application of the system, including applications other than hockey arenas or other sporting venues, and are well within the skills of one of ordinary skill in the art.

Figure 2:
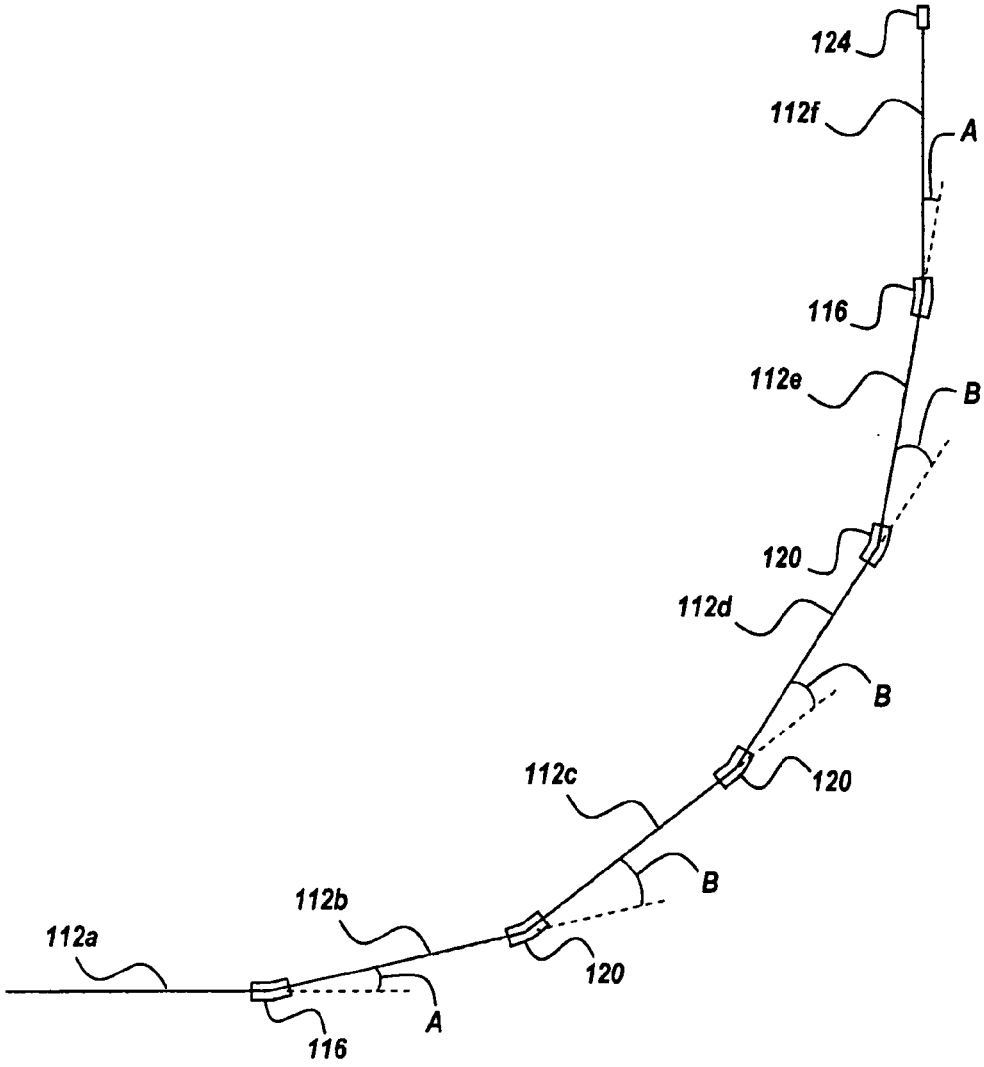
FIG. 2 is an illustration of the configuration of the supporting segments of a safety net or other partition of an embodiment of the invention.

Referring now to FIG. 2, a configuration of segments 112 for a portion of the playing area 104 of FIG. 1 is now described. In this embodiment, the segments 112 are coupled to other segments 112 with couplings that are selected based on the position of the segments 112 relative to the playing area 104. In this embodiment, a first coupling 116 couples two segments 112 at an angle of 11.25 degrees relative to one another. This angle is selected based on the geometry of the area that is to be partitioned. In this embodiment, the first coupling 116 is selected to be 11.25 degrees in order to have an approximate correspondence between the segments 112 and the boundary of the playing area 104. In the embodiment of FIGS. 1 and 2, a second coupling 120 is used to couple three segments 112 between the first coupling 116. In this embodiment, the second coupling 120 couples two segments 112 together at an angle of 22.5 degrees. Finally, a third segment 124 is used to couple segments 112 together, at an angle of zero degrees, thus resulting in the two coupled segments 112 forming a straight line. In the embodiment of FIG. 2, a segment 112*a* is coupled with a first coupling 116 to a second segment 112*b*. The segments 112*a*, 112*b* are coupled by the first coupling 116 at a first angle A, which in one embodiment is about 11.25 degrees. Section 112*b* is followed by three segments 112*c*, 112*e*, 112*e* coupled together with a second coupling 120 at a second angle B, which in one embodiment is about 22.5 degrees. A sixth segment 112*f* is coupled to segment 112*e* by a first coupling 116 at angle A. In this manner, six segments 112*a*–112*f* are coupled together to span one half of one end of the playing area 104. Six additional segments 112 are coupled together in a similar fashion to span the other half of the end of the playing area 104, with the two halves coupled with a third coupling 124. In this manner, the segments 112 form a piecewise linear approximation the geometry of the playing area 104 being partitioned with the safety net 106. It is noted that the addition of the six angles of FIG. 2, namely the two angles A and the three angles B, adds to 90 degrees. Thus, the assembly of the six segments 112*a* through 112*f*, rotates through an angle of 90 degrees, as is expected. Similarly, when six additional segments 112 are assembled in a similar fashion to complete the end of the hockey arena, the segments will rotate through an angle of 180 degrees, providing complete coverage for each end of the hockey rink. As will be readily understood, while a hockey rink 104 is illustrated in the embodiment of FIG. 1, a similar system may be used for purposes of partitioning any of a number of sporting venues, as well as other venues requiring partitions. In such embodiments, the couplings may be selected to couple adjacent segments at virtually any desired angle to result in a configuration suitable to hang the partition at an appropriate proximity to the boundary of the area being partitioned.

Figure 3:
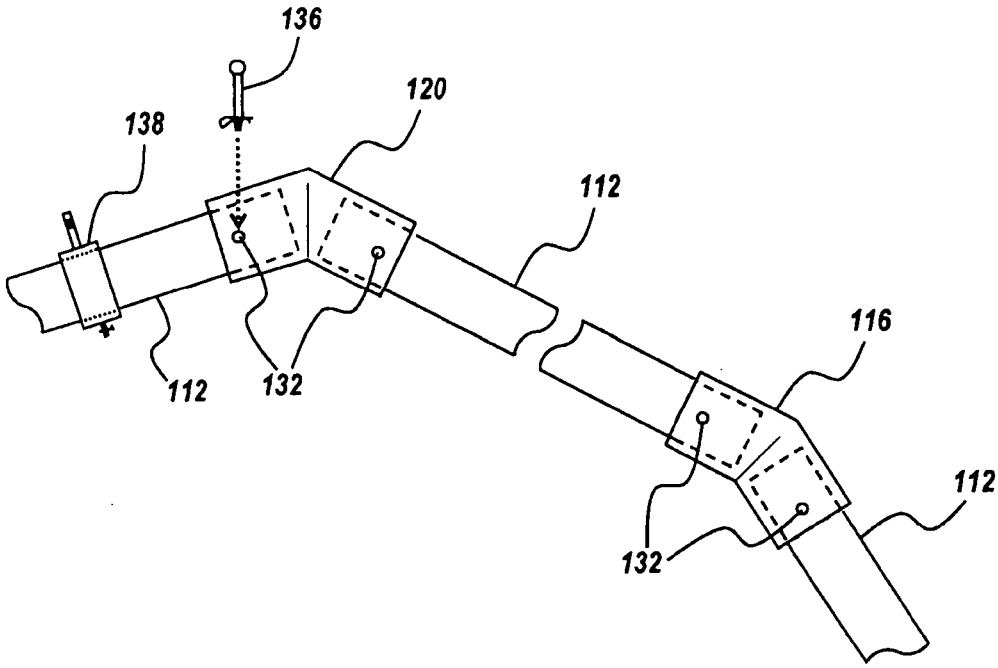
FIG. 3 is an illustration of supporting segments and associated couplings and lifting eyes for an embodiment of the invention.

Referring now to FIG. 3, a detail illustration of segments 112 and a first coupling 116 and a second coupling 120 is now described. As illustrated, a first coupling 116 includes securement holes 132 that align with a securement hole within the segment. A securement pin 136 may be inserted when the securement hole within the segment 112 is aligned with securement hole 132. In this manner, the segments 112 are coupled together securely. In this embodiment, the couplings 116, 120 are formed from structural steel that has a square cross-section and is sized to accommodate the segments 112. Furthermore, in this embodiment, the couplings 116, 120 are adapted to receive segments 112 on each end of the coupling. In other embodiments, the couplings 116, 120 may be securely affixed to one end of a segment 112, such as by a weld. In this manner, the couplings 116, 120 are secured to a segment 112 and may be coupled with another segment 112 using securement holes 132 and securement pins 136. In another embodiment, each segment has one or more spring biased fingers that may be depressed when the segment is inserted into a coupling and that latch into place in the securement holes when the segment is moved to the appropriate position within the coupling. When disassembling the pieces, the fingers may again be depressed and the segment removed from the coupling. Furthermore, other methods of securing the segments 112 together may be used, such as, for example, flanges that may be secured together, clamps, bolts, safety pins, adjustable hinges, and free-moving hinges.

A moveable lifting eye 138 may be attached to a segment 112 and used as a lifting point for lifting the assembled segments into position. In the embodiment of FIG. 3, a single moveable lifting eye 138 is illustrated for purposes of discussion, and a number of such lifting eyes 138 are affixed to the assembled segments 112 to provide adequate lifting support for the assembled segments 112 and net or other partition. The moveable lifting eye 138 of this embodiment is adapted to be coupled to a lifting chain or cable attached to a lift system. The lifting eyes 138 may be moved to appropriate positions on the associated segments to provide adequate support for lifting, lowering, and supporting the assembled segments 112 and associated net. Other types of lifting points may also be used such as, lifting points fixed at periodic places on the support segments, lifting holes or slots formed in the segments, and threaded lifting eyes that may be screwed into preexisting threaded holes in the support members, to name but a few.

Figure 4A:
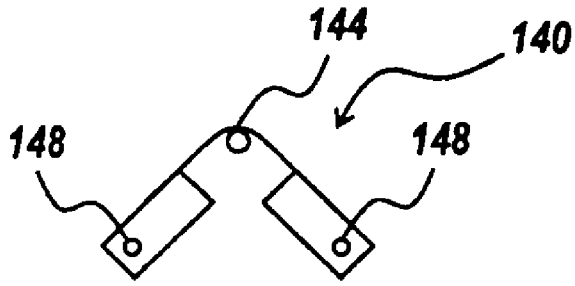
FIG. 4 is an illustration of a coupling of another embodiment of the present invention.
Figure 4B:
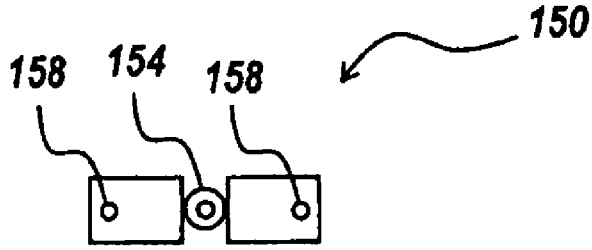
Figure 5:
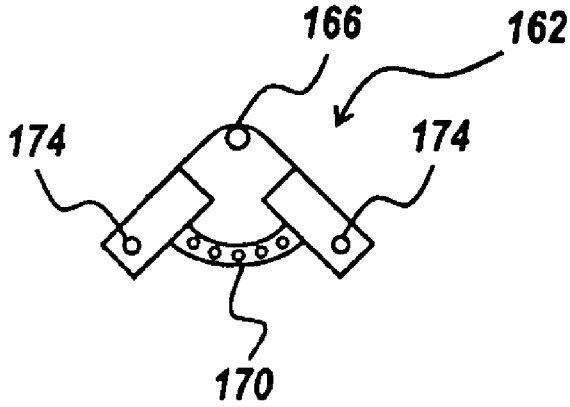
FIG. 5 is an illustration of a coupling of a further embodiment of the present invention.

Referring now to FIGS. 4 and 5, other embodiments of couplings are described including free moving hinges of FIGS. 4A and 4B, and fixed hinges of FIG. 5. In the embodiment of FIG. 4A, a coupling 140 is illustrated that includes a hinge 144. The hinge 144 may be one of any number of hinges, and in one embodiment is a case hardened pin hinge. The hinge 144 allows the coupling 140 to couple segments at a number of different angles to provide a partition to a number of differing geometry areas that are to be partitioned. In one embodiment, the coupling 140 includes securement holes 148 that may align with securement holes within the segments and a securement pin may be placed in the aligned holes to secure the segments together. Similarly as discussed above, the coupling 140 may be securely affixed to one segment such as by a weld, and another segment may be coupled thereto by any of the above-described, or other, mechanisms. In the embodiment of FIG. 4B, a coupling 150 is illustrated that includes a hinge 154. The hinge 154 of this embodiment is a case hardened pin hinge that is secured directly to each end of the coupling 150. The hinge 154 of this embodiment may freely rotate to angles between zero and ninety degrees. The coupling 150 also includes securement holes 158 that may align with securement holes within the segments and a securement pin may be placed in the aligned holes to secure the segments together. Similarly as discussed above, the coupling 150 may be securely affixed to one segment such as by a weld, and another segment may be coupled thereto by any of the above-described, or other, mechanisms.

FIG. 5 illustrates a hinged coupling 162, with a hinge 166 and an angle setting mechanism 170. In this embodiment, the angle setting mechanism 170 includes arms that may be secured to one another to provide a fixed angle for the coupling 162. Similarly as described above, securement holes 174 may be used to secure the coupling 162 to segments. Also, similarly as discussed above, the coupling 162 may also be securely affixed to a segment on one end. Furthermore, in an embodiment, two segments may be coupled to a hinged coupling, and further coupled to other segments with a coupling 120 such as described with respect to FIGS. 1–3. In one embodiment, two segments 112 may be permanently coupled with a hinged coupling and pivoted about the hinge such that the segments 112 are next to one another to provide for convenient storage.

Figure 6:
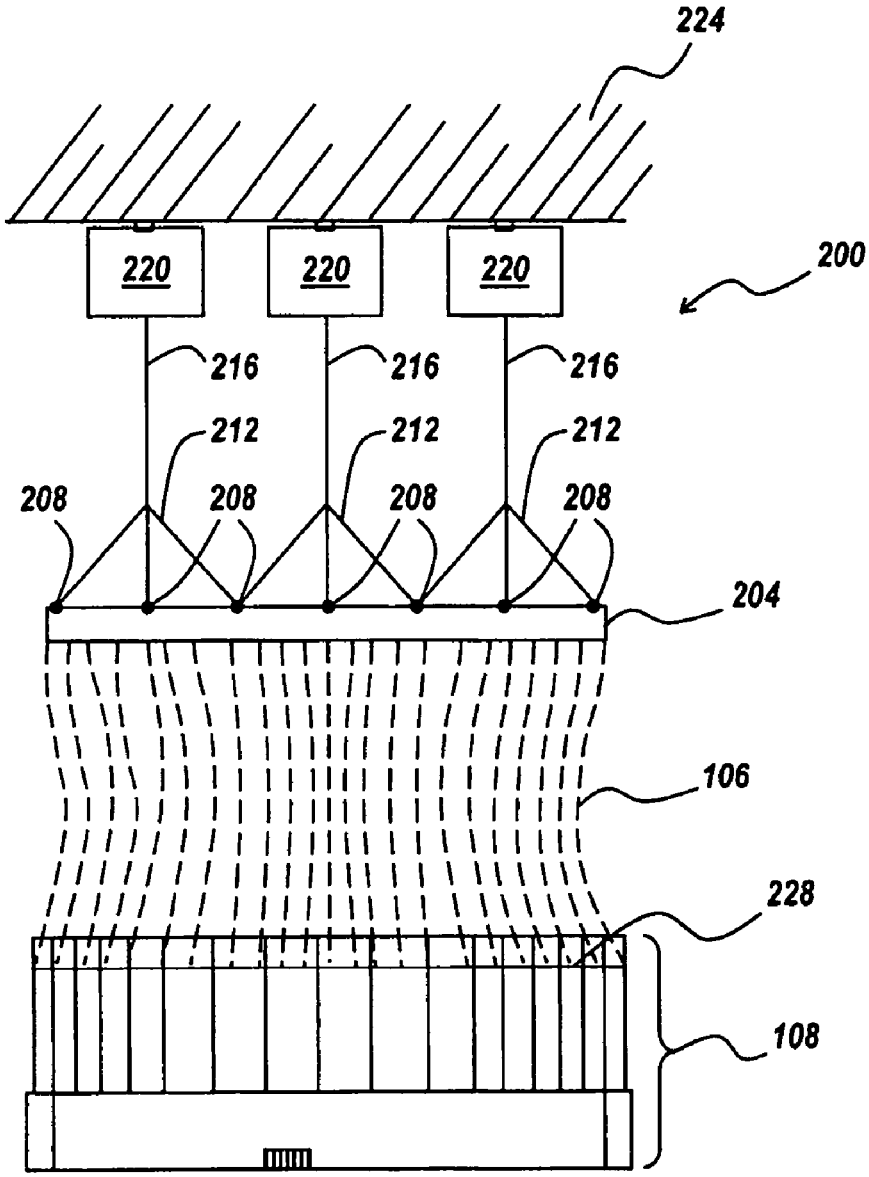
FIG. 6 is an elevation illustration of a lift system, assembled segments and couplings, safety net, and playing arena of an embodiment of the present invention.

Referring now to FIG. 6, a lift system 200 of an embodiment of the invention is now described. In this embodiment, the assembled segments and couplings, denoted in this figure as 204, are attached at several lift points 208 by cables 212 to a chain 216 and a lift motor 220. The lift motors 220 are secured to a structure 224, such as a truss located above the screened area. The lift points 208 may be selected to provide adequate lift support for the segments and couplings 204 and the safety net 106. While three lift motors 220 are illustrated in FIG. 6, this number is selected solely for purposes of illustration and discussion. It will be understood that more or fewer lift motors 220 may be used, depending upon the application. In one embodiment, six lift motors 220 are provided for each end of a hockey arena, with each lift motor 220 having a 300 pound lift capacity. In this embodiment, the safety net 106 is secured to glass partitions 108 associated with a hockey arena by a cable 228 located at an upper portion of the glass partition 108. In this embodiment, the lift motors 220 are coupled to a common lift control such that all of the motors 220 are operated substantially simultaneously to lift the safety net 106 evenly to a point that the safety net 106 provides a predetermined amount of deflection. As will be recognized, the amount of deflection may be selected based on the application, and in one embodiment is about five pounds of deflection. In one embodiment, the safety net 106 is lifted to a point where the top of the safety net is about 24 feet above the top of the partition glass 108. In another embodiment, the safety net 106 is lifted to a point above the top of the partition glass 108 that is dependant on the size of the net. The height of the safety net 106, or other partition, may also be selected based on the particular application. While lift motors are described in this embodiment, other embodiments exist in which the system is lifted using other mechanisms, such as manual lifting using pulleys and manual lifting by various persons located on catwalks, for example.

Figure 7:
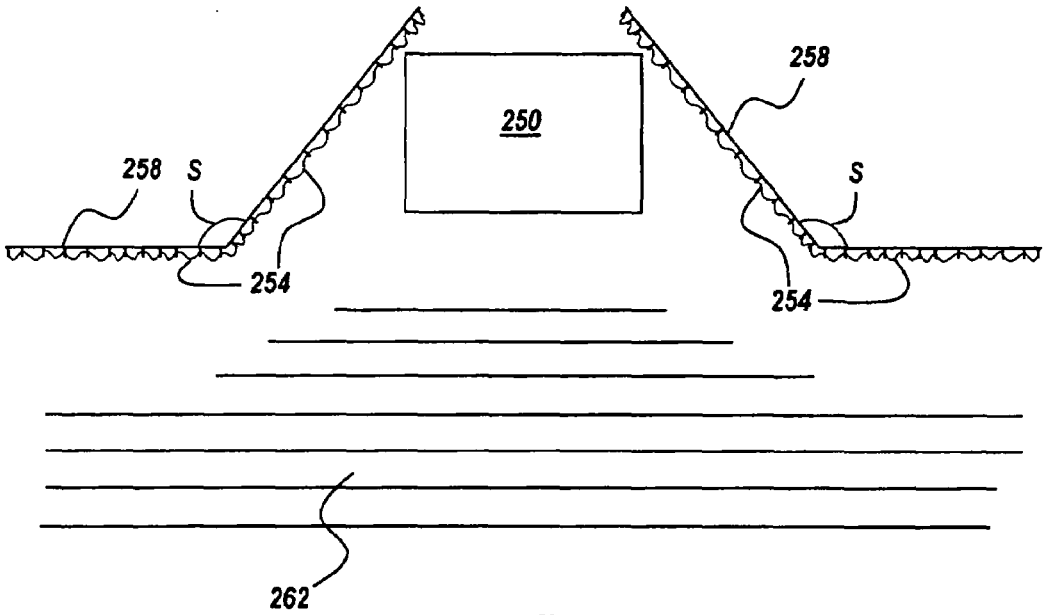
FIG. 7 is a plan view of an embodiment of the invention providing a screen for a stage.

Referring now to FIG. 7, a schematic diagram of another embodiment of the invention is described. In this embodiment, the system is used to screen a stage area 250 by hanging a curtain 254 from the assembled segments 258. In this embodiment, the assembled segments 258 are arranged in a configuration to provide adequate sight lines from a seating area 262 to the stage 250, while providing a screen from other areas. In this embodiment, several segments may be coupled in a linear fashion together, with one coupling providing an angle S that provides the boundary of the screened area. The segments may be coupled together using any suitable coupling, such as described above. The assembled segments 258 are attached to a number of lift points and the assembly may be lifted using motors similarly as described above with respect to FIG. 6.

Figure 8:
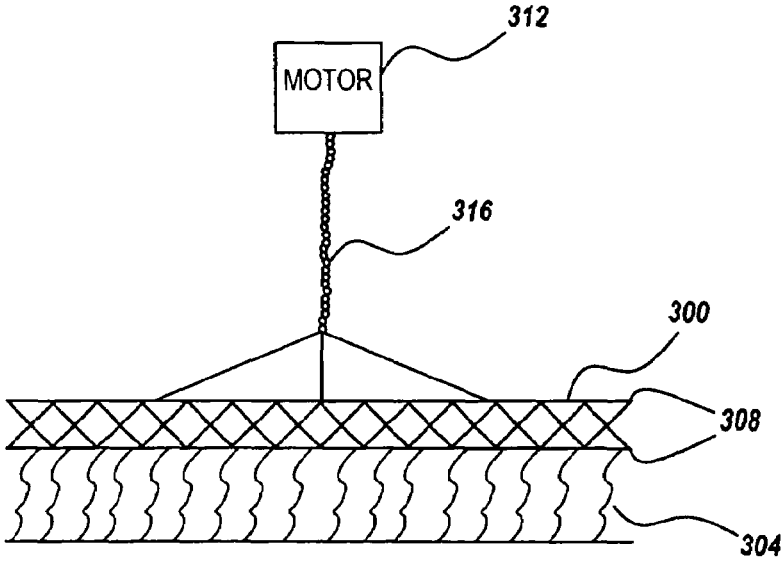
FIG. 8 is an illustration of a segment of another embodiment of the invention.

With reference to FIG. 8, a segment of another embodiment is described. In this embodiment, the segment 300 is a truss type segment such as an aluminum ladder truss. Such a segment 300 may provide additional support that may not be available with, for example, a steel tube segment as described above. Such additional support may be beneficial when the assembled segments are to support a relatively heavy partition, such as a heavy net or curtain 304. Such segments 300 may also be coupled together using any of a number of couplings 308 that will be readily ascertainable by one of skill in the art, including, for example, plate couplings and hinge joints. Furthermore, the coupling 308 may be integrated into each end of the segments 300, with multiple options available to provide appropriate angles of coupling between consecutive segments 300. The segment 300 and associated partition 304 may be raised and lowered using a motor 312 and associated chain or cable 316. In one embodiment, the truss segments 300 are selected to be of sufficient strength to allow for fewer lift points than would be required for square tube steel segment as described above to support the same load. Furthermore, numerous other types of segments may be used, including plastic or PVC tubes, I-beams, solid rods, and wooden boards, to name but a few.

As will be readily recognized, the system described herein may be used in a number of venues and facilities. In particular, the above described system is advantageous when used in facilities that are used for multiple functions, such as a sporting arena that is used for multiple sporting events in multiple different sports, as well as other non-sporting events such as concerts and assemblies. In such a facility, the time in which the facility must be converted from one use to another is often limited. Using a system described herein, the partition or net may be assembled, lifted into place, and removed with relative ease. The linear segments provide for easy storage and transport of the unassembled system. For example, the system may be stored on wheeled storage rack that may be moved between a storage area and the area to be partitioned. As will be recognized, the linear segments may be stacked and stored in a relatively small volume due to the geometry of the segments. The couplings and any required coupling pins may also be stored in a relatively small volume along with the segments. The linear segments may be assembled one at a time to the associated couplings until the segments are assembled in the desired shape. The net, or other partition, may then be secured to the segments, and the segments attached at the lift points to the lifting mechanism. The assembled segments, and net, may then be lifted by the lift system until the net is in the appropriate position. The net may then be secured to the appropriate partition(s), such as the above-described glass and dasher board system. In other embodiments, the net, or other partition, may not be physically secured at the bottom and instead allowed to hang in the appropriate position corresponding to the area being partitioned. The net, or other partition, in this embodiment may have associated weights, such as a chain, secured to the bottom thereof to provide an appropriate amount of deflection force for the partition. Likewise, when it is necessary to remove the net, the net may be removed from the partition(s) (if necessacy), the assembled segments and net lowered with the lift system. The net is then removed from the assembled segments and segments are disassembled and may be placed onto the storage cart and removed for storage. As will be recognized, such a system provides for both safety of spectators, and also provides relatively easy installation, removal, and storage. Furthermore, while many of the above examples pertain to a hockey arena, it will be understood that the system may be used in numerous other applications where a net or other partition is desired.

While the invention has been particularly shown and described with reference to a preferred embodiment thereof, it will be understood by those skilled in the art that various other changes in the form and details may be made without departing from the spirit and scope of the invention.

What is claimed is:

1. A safety net system for reducing the number of objects entering a spectator area from a sporting area in a sports venue, comprising:

a plurality of support members;

a plurality of couplings, each coupling operably interconnected with two of said support members, at least two of said support members coupled at a predetermined angle other than zero degrees relative to one another and forming a piecewise linear approximation of at least a portion of a boundary of the sporting area;

a safety net attached to said support members and hanging in a substantially vertical and downward direction therefrom; and a plurality of lifting points associated with said plurality of support members and said plurality of couplings, each of said plurality of lifting points engaging a line that supports said plurality of support members, plurality of couplings, safety net, and plurality of lifting points from a location above said plurality of support members, plurality of couplings, safety net, and plurality of lifting points.

2. The safety net system, as claimed in claim 1, wherein each of said support members is substantially linear.

3. The safety net system, as claimed in claim 1, further comprising:

a lift system operably interconnected with said plurality of support members and operable to lift said plurality of support members, plurality of couplings, plurality of lifting points, and safety net into a predetermined position.

4. The safety net system, as claimed in claim 1, wherein said safety net extends between said support members and an upper portion of a glass partition associated with a hockey arena.

5. The safety net system, as claimed in claim 4, wherein said plurality of support members include 12 support members located at end of the hockey arena, and wherein said support members are coupled at one of an angle of about 11.25 degrees, about 22.5 degrees, and zero degrees.

6. The safety net system, as claimed in claim 1, wherein said support members are substantially square steel tubes having a support member securement hole, and wherein said couplings have coupling securement holes substantially aligned with said support member securement holes, and wherein a securement pin is located in said substantially aligned securement holes to secure said support members to said couplings.

7. The safety net system, as claimed in claim 1, wherein said plurality of support members and said plurality of couplings all lie substantially in a single plane.

8. A system for providing a removable screen in a multiple use event center, comprising:

a screen;

a plurality of elongate support members, each of said elongate support comprising a coupling point for coupling to another one of said plurality of elongate support members;

a plurality of couplings, with at least one of said couplings operable to connect a first support member to a second support member at a fixed angle, other than zero degrees, wherein said plurality of support members are assembled into a shape corresponding to a piecewise linear approximation of at least a portion of a boundary of the screened area;

a plurality of screen hanging points for engaging said screen so that, in operation, said screen hangs substantially vertically downward therefrom;

a plurality of lifting points, each lifting point for engaging a line that is used to hoist said screen, said plurality of elongate support members, said plurality of couplings, said plurality of screen hanging points, and said plurality of lifting points from a location above said screen, said plurality of elongated support members, said plurality of couplings, said plurality of screen hanging points, and said plurality of lifting points.

9. The system for supporting a removable screen, as claimed in claim 8, wherein each of said support members is substantially linear.

10. The system for supporting a removable screen, as claimed in claim 8, further comprising:

a lift system for operably interconnecting with said plurality of support members and operable to lift said plurality of support members, plurality of couplings, plurality of screen hanging points, and plurality of lifting points, and screen into a predetermined position.

11. The system for supporting a removable screen, as claimed in claim 8, wherein the removable screen is a safety net for interposing between a playing field or area and a spectator area in a sporting arena.

12. The system for supporting a removable screen, as claimed in claim 11, wherein the safety net has sufficient height to extend between an upper portion of a glass partition associated with the hockey arena and a location above an upper portion of such a glass partition.

13. The system for supporting a removable screen, as claimed in claim 8, wherein said support members are substantially square steel tubes, wherein said coupling points comprise a support member securement hole, and wherein said couplings are adapted to engage said steel tubes and have coupling securement holes substantially aligned with said support member securement holes when said support member is engaged with said coupling, and wherein a securement pin is operable to be placed through said substantially aligned securement holes to secure said support members to said couplings.

14. A method for partitioning a portion of a multiple-use facility comprising:

assembling a plurality of segments into a predetermined configuration corresponding to a piecewise linear approximation of a boundary of the area to be partitioned, at least one segment coupled to another segment at a fixed angle other than zero degrees;

fixing a partition to said segments;

attaching a lifting device to said plurality of segments, said lifting device operable to apply a lifting force to said plurality of segment from a location above said plurality of segments; and raising, using said lifting device, said segments and said partition to place said partition in an operative position.

15. The method for partitioning a portion of a multiple-use facility, as claimed in claim 14, wherein said assembling step comprises:

obtaining a segment;

obtaining a coupling having a predetermined angle;

affixing said coupling to said segment;

obtaining a second segment;

affixing said second segment to said coupling such that said segment and said second segment are coupled together at said predetermined angle; and repeating said steps of affixing and obtaining until said segments form a desired configuration.

16. The method for partitioning a portion of a multiple-use facility, as claimed in claim 14, wherein said partition is a safety net for interposing between a playing field or area and a spectator area in a sporting arena.

* * * * *